US005331735A

United States Patent [19]

Hotaling

[11] Patent Number: 5,331,735

[45] Date of Patent: Jul. 26, 1994

[54] METHOD OF FORMING A FLEXIBLE CONNECTOR

[75] Inventor: William R. Hotaling, Ballston Spa, N.Y.

[73] Assignee: General Electric Company, Schenectady, N.Y.

[21] Appl. No.: 53,284

[22] Filed: Apr. 28, 1993

[51] Int. Cl.[5] ..... H01R 43/04

[52] U.S. Cl. ..... 29/882; 29/33 M; 29/469; 29/599; 29/609; 29/829; 72/363

[58] Field of Search ..... 72/363; 29/609, 829, 29/469, 33 M, 599, 876, 882

[56] References Cited

U.S. PATENT DOCUMENTS

| | | | |
|---|---|---|---|
| 2,671,951 | 3/1954 | Sliwiak | 29/609 |
| 3,202,851 | 8/1965 | Zimmerle et al. | 29/609 X |
| 3,497,949 | 3/1970 | Salt | 29/609 |
| 3,840,983 | 10/1974 | Ryff | 72/363 X |
| 4,538,345 | 9/1985 | Diederichs | 29/609 X |

FOREIGN PATENT DOCUMENTS

| | | | |
|---|---|---|---|
| 44-3477 | 2/1969 | Japan | 72/363 |

*Primary Examiner*—Carl J. Arbes
*Attorney, Agent, or Firm*—James Magee, Jr.

[57] ABSTRACT

A method is disclosed for forming a flexible connector. An outer die is formed having a mold surface defining an outer surface of the connector. An inner die is formed to have an outer surface defining an inner surface of the connector. A plurality of sheets is inserted into the mold surface with the inner die to form a compact assembly. The assembly is milled to align the sheet edges, and the aligned edges are joined in predetermined sections to form the flexible connector.

9 Claims, 2 Drawing Sheets

METHOD OF FORMING A FLEXIBLE CONNECTOR

BACKGROUND OF THE INVENTION

This application is related to copending applications Ser. No. 833,225, filed Feb. 10, 1992, Ser. No. 833,194, filed Feb. 10, 1992, and Ser. No. 000,303, filed Jan. 4, 1993.

This invention relates to a method of forming a flexible connector from a plurality of sheets.

Flexible connectors formed from a plurality of metallic sheets are disclosed in U.S. Pat. No. 5,129,232. The connectors are configured to flex to provide vibration isolation and damping between components, for example, in a cryocooled superconducting magnet. The connectors are formed from a plurality of metallic sheets configured to behave independently of each other to provide flexibility with minimized stiffness. The metallic sheets are joined together to act as a coordinated body by welding preselect sections of the sheet edges together.

For example, in the '232 patent a stack of about 25 copper sheets, each about 0.005 inch thick, is formed into a U or V shaped connector. The stack of sheets is bent around a thin steel plate, and the upper ends of the U or V shaped laminated body are welded together to form the flexible connector.

An aspect of this invention is to provide a simple method for forming such flexible connectors with a high degree of alignment of the sheet edges for forming a strong joint.

BRIEF DESCRIPTION OF THE INVENTION

The method of this invention for forming a flexible connector comprises, forming an outer die having a mold surface defining an outer surface of the connector. Forming an inner die to have an outer surface defining an inner surface of the connector. Forming a compact assembly of the outer die and a plurality of sheets inserted into the mold surface with the inner die, the sheets having surfaces facing the mold surface and inner die, and sheet edges normal to the surfaces. Milling the assembly to align the sheet edges, and joining the aligned edges in predetermined sections to form the flexible connector.

BRIEF DESCRIPTION OF THE DRAWINGS

The method of this invention is further shown by considering the following detailed description in conjunction with the accompanying drawings wherein like characters represent like parts throughout the several views, and in which.

DETAILED DESCRIPTION OF THE INVENTION

The flexible connector is formed from a plurality of sheets of varying size. For example, sheets at the innermost surface of the connector can have a smaller length as compared to the sheets on the outer most surface of the connector. However, the sheets must be aligned and formed to the precise dimensions required to provide for alignment of the sheet edges so that a strong weld joint can be formed between all the sheets in the connector. The method of this invention provides for such precise alignment of the sheets, and the sheet edges. The aligned sheet edges can then be joined to form a strong joint between all the sheets in the connector while retaining the shape of the flexible connector.

Figure 1:
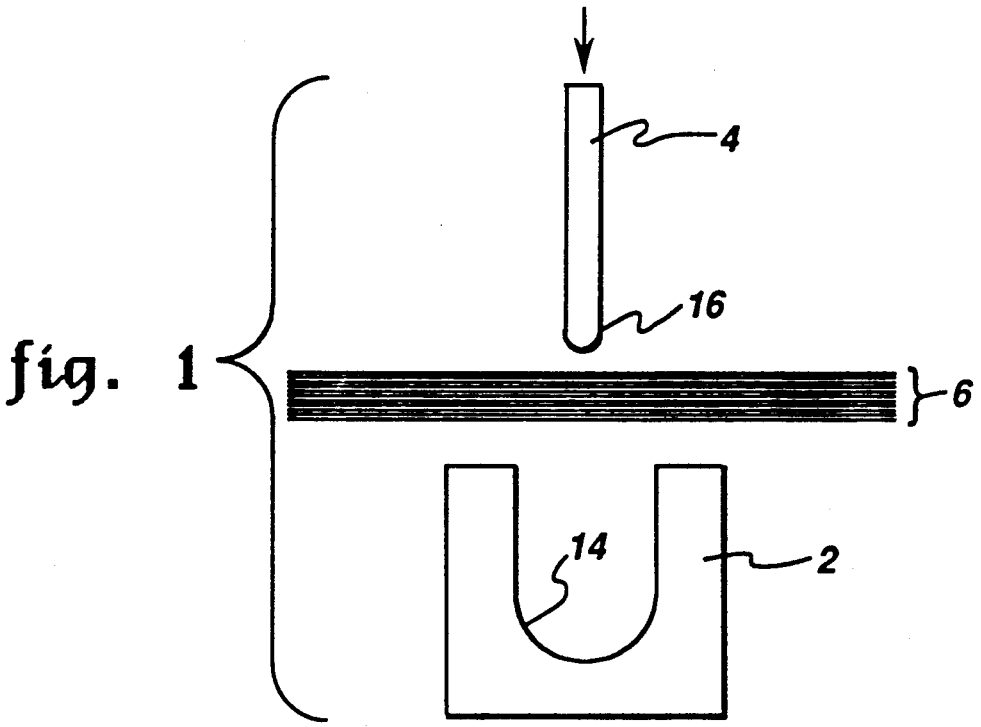
FIG. 1 is an exploded schematic view of an inner die, an outer die, and a plurality of sheets for forming a flexible connector.
Figure 4:
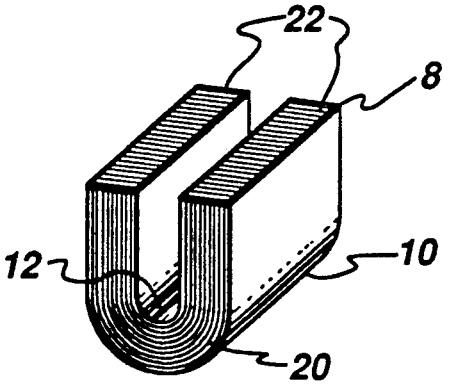
FIG. 4 is a view of the flexible connector removed from the dies.

Referring to FIG. 1, there is shown a schematic view of an outer die 2, an inner die 4, and a plurality of sheets 6, that can be used to form a flexible connector 8, for example shown in FIG. 4. The outer die 2 and inner die 4 can be formed from a material having strength for bending the plurality of sheets, and is machineable, such as aluminum or steel. The sheets can be formed from metals providing properties required in the particular flexible connector, such as aluminum, steel, copper, or alloys thereof. For example, a connector having good thermal conductivity can be formed from copper sheets.

Referring to FIG. 4, the flexible connector 8 has an outer surface 10 formed by the outermost sheet, and an inner surface 12 formed by the innermost sheet in the connector. Referring back to FIG. 1, the outer die 2 is formed with a mold surface 14 that defines the outer surface of the flexible connector. For example, if the flexible connector is U-shaped, the outer die 2 can be a rectangular block, and the mold surface 14 is formed as a U-shaped cavity extending across one side thereof. The U-shaped cavity of mold surface 14 mating with the outer surface of the U-shaped flexible connector.

The inner die 4 is formed to have an outer surface 16 defining the inner surface of the flexible connector. For example, for the U-shaped connector 8, shown in FIG. 4, the inner die 4 can be formed from a rectangular block that is milled so its outer surface 16 conforms to the smaller U-shaped dimensions of the inner surface 12 of the flexible connector. The plurality of sheets 6 are inserted into the mold surface 14 of the outer die 2 with the inner die 4 to form a compact assembly 18, shown in FIG. 2.

Preferably, the sheets fill the space between the inner die 4 and outer die 2 to form a tight fit in the compact assembly 18. The sheets 6 have major width and length dimensions forming sheet surfaces that face the mold surface 14 and inner die 4, and sheet edges 20 in the minor thickness dimension normal to the sheet surfaces. Preferably, the sheets 6 have a sufficient width and length to protrude form the mold surface 14 at least where the sheets are to be milled and joined, for example at the upper end of the U-shaped mold surface as shown in FIG. 2.

Figure 3:
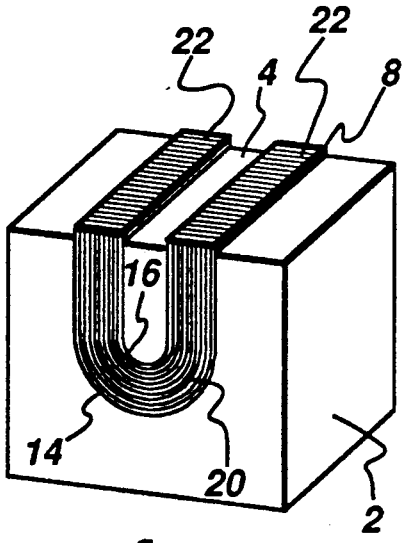
FIG. 3 is a perspective view of the assembly in FIG. 2 after milling the assembly and welding the sheets to form the flexible connector.

Referring to FIG. 3, the assembly is milled to align the sheet edges to conform to the outer dimensions of the flexible connector. The aligned sheet edges are then joined, for example by welding, brazing, or soldering in preselected sections to form the flexible connector. For example, the aligned ends can be welded at the upper ends 22 of the U-shaped flexible member. Preferably, the inner die 4 and outer die 2 are be milled in areas adjacent the sections of the sheets that are to be joined so that the sheets protrude therefrom, as shown in FIG. 3. The exposed aligned edges are then joined, for example by electron beam welding, without melting the die and contaminating the welds formed on the sheet edges.

Figure 2:
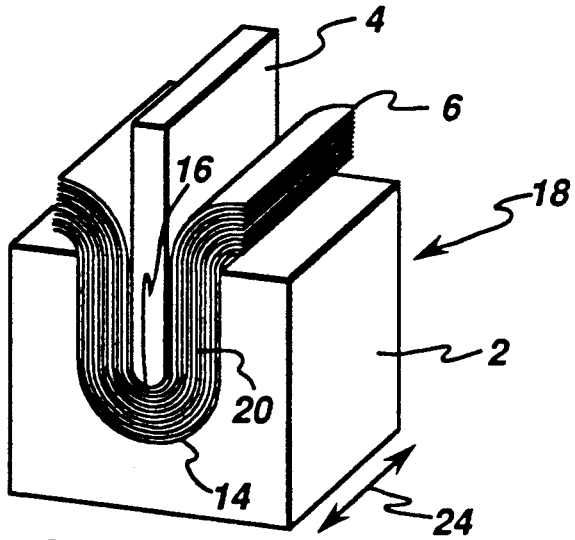
FIG. 2 is a perspective view of the assembled elements in FIG. 1.

Referring to FIG. 2, the outer die 2, inner die 4, and sheets 6 have a width dimension shown by arrow 24. A number of flexible connectors can be formed by providing the width dimension 24 of the outer die 2, inner die 4, and sheets 6 to be a desired multiple of the width of the connector. After milling to align the sheet edges, the compact assembly can be cut into sections along the width dimension to form the desired number of connectors.

FIGS. 5-8 show the method of this invention for forming a flexible connector having a different configuration.

Figure 5:
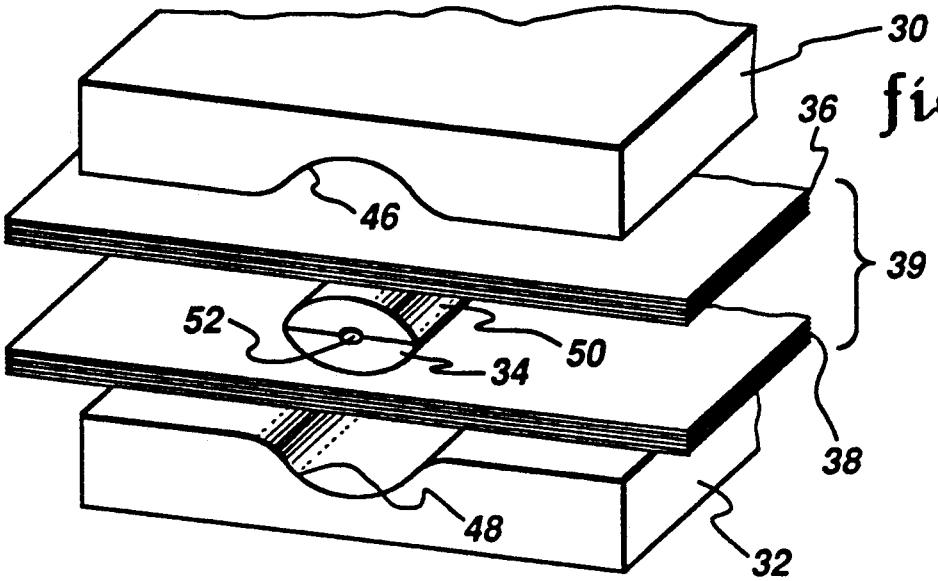
FIGS. 5–8 correspond to FIGS. 1–4 showing a different flexible connector configuration.
Figure 6:
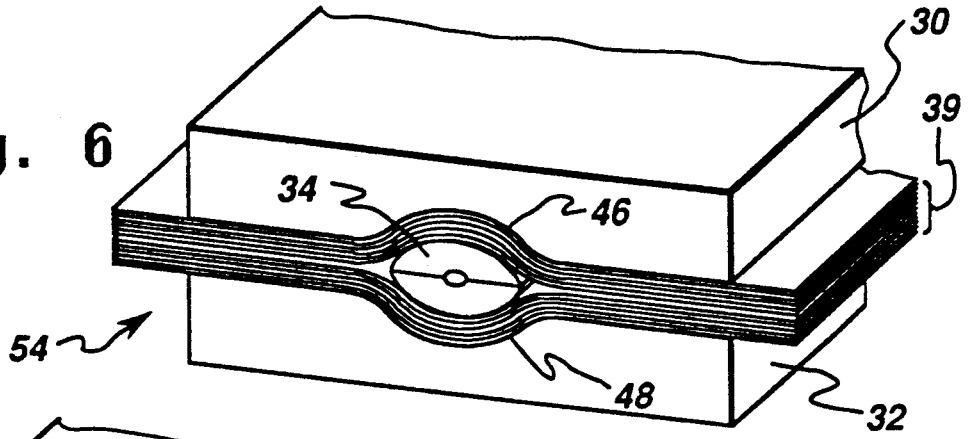
Figure 8:
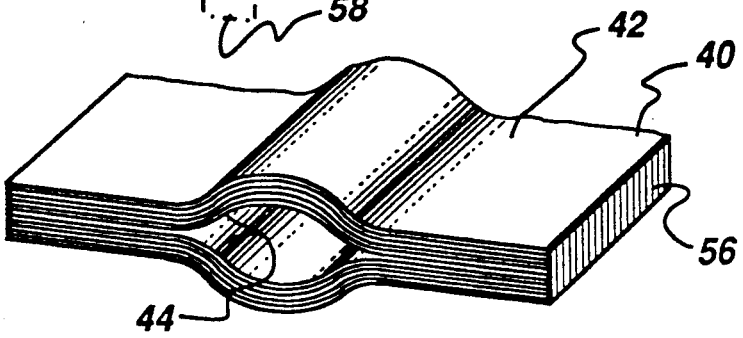

Referring to FIG. 5, there is shown a perspective view of outer dies 30 and 32, inner die 34, and first and second portions 36 and 38 of a plurality of sheets 39 for forming a flexible connector 40, shown in FIG. 8. The dies and sheets can be formed from the materials discussed above. Referring to FIG. 8, the flexible connector 40 has an outer surface 42 formed by the outer most sheets in the connector, and an inner surface 44 formed by the innermost sheets in the connector.

Referring back to FIG. 5, the outer dies 30 and 32 are formed with mold surfaces 46 and 48 that define the outer surface of the flexible connector. For example, the outer dies 30 and 32 can be formed from rectangular blocks. One surface on each block is milled to form a cavity of a predetermined radius extending across the midsection of the surface to form the mold surfaces 46 and 48.

The inner die 34 is formed to have an outer surface 50 defining the inner surface 44, such as the elliptical surface shown in FIG. 8, of the flexible connector. For example, the inner die 34 can be formed from a cylindrical rod having an outer radius conforming to the radius at the top and bottom half of the elliptical inner surface 44. Two sections of the outer radius of the cylindrical rod corresponding to the top and bottom of the elliptical inner surface are removed from the rod, and positioned together to form the eliptical inner die 34. Preferably, a bore is formed extending into the two radius sections and a pin 52 inserted in the bore to maintain the alignment between the two sections.

The first portion 36 and second portion 38 of the plurality of sheets 39 are positioned adjacent the first die 30 and second die 32, respectively, so that the sheet surfaces are facing the mold surfaces 46 and 48. Preferably, the sheets have a sufficient width and length to protrude from the mold surfaces 46 and 48 at least where the sheets are to be milled and joined. The inner die 34 is positioned between the first portion 36 and second position 38, and in alignment between the cavities in the first mold surface 46 and second mold surface 48. The first and second dies are then urged together, for example with clamps not shown, to compress the sheets therebetween and around the inner die 50 to form a compact assembly 54, shown in FIG. 6.

Figure 7:
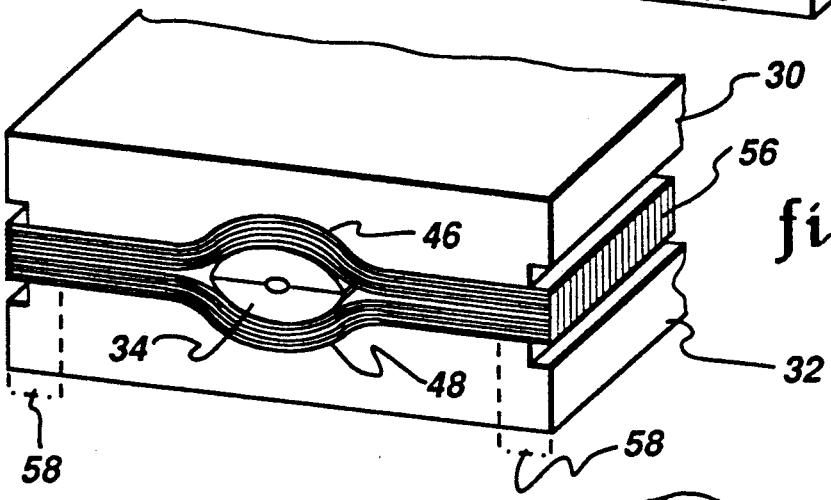

Referring to FIG. 7, the compact assembly 54 is milled to align the sheet edges at least in the sections to be joined. Preferably, the dies were slightly oversized so that the assembly 54, and all the sheet edges are milled to conform to the outer dimensions of the flexible connector 40. Preferably, the outer die 30 and 32 are milled in areas 53 and 55 adjacent the sections of the sheet that are to be joined so that the sheet edges protrude therefrom. The aligned sheet edges are then joined, for example by welding, brazing, or soldering in the preselect sect ions to form the flexible connector.

It should be understood that the preselect sections that are welded are determined by the flexibility and vibration damping properties required in the connector. For example, the sections 56 of sheet edges extending from the ends of the outer dies can be welded, for example by electron beam welding. However, an additional section 58 along the sides of the sheets in the compact assembly 54 can also be welded to form the connector. The outer dies are separated from the flexible connector and the inner die is removed from the inner surface 44 leaving the flexible connector 40, as shown in FIG. 8.

What is claimed is:

1. A method of forming a flexible connector, comprising;

forming an outer die having a mold surface defining an outer surface of the connector, forming an inner die having an outer surface defining an inner surface of the connector, forming a compact assembly of the outer die and a plurality of sheets inserted into the mold surface with the inner die, the sheets having surfaces facing the mold surface and inner die, and sheet edges normal to the surfaces, milling the assembly to align the sheet edges, and joining the aligned sheet edges in predetermined sections to form the flexible connector.

2. A method according to claim 1 comprising, before the step of joining, milling the outer and inner die so that the predetermined sections of the sheet edges extend therebeyond.

3. A method according to claim 2 wherein, the sheets are joined by electron beam welding.

4. A method according to claim 1 wherein the connector is U-shaped, the outer die is a rectangular block, and the mold surface is a U-shaped cavity extending across one side of the block.

5. A method according to claim 1 wherein the connector is V-shaped, the outer die is a rectangular block, and the mold surface is a V-shaped cavity extending across one side of the block.

6. A method according to claim 1 wherein the outer die is comprised of a first rectangular block having a first side and a second rectangular block having a second side, the first and second sides having a cavity of a predetermined radius extending thereacross to form the mold surface, and the step of forming the compact assembly comprises positioning a first portion of the plurality of sheets adjacent the first side and a second portion of the plurality of sheets adjacent the second side, the inner die positioned between the first and second portions and aligned between the cavity in the first and second sides, and urging the first and second blocks together to compress the sheets therebetween.

7. A method of forming a flexible connector from a plurality of sheets, the sheets having surfaces and the innermost sheet surface forming an inner surface of the connector and the outermost sheet surface forming an outer surface of the connector, the method comprising;

forming an outer die comprised of a first rectangular block having a first side and a second rectangular block having a second side, the first and second sides having a cavity of a predetermined radius extending thereacross to define the outer surface of the connector, forming an inner die having an outer surface defining the inner surface of the connector, positioning a first portion of the plurality of sheets adjacent the first side and a second portion of the plurality of sheets adjacent the second side, the inner die positioned between the first and second portions and aligned between the cavity in the first and second sides, urging the first and second blocks together to compress the sheets around the inner die and between the first and second sides, the sheets having sheet edges normal to the sheet surfaces, milling the assembly to align the sheet edges, and joining the aligned edges in predetermined sections to form the flexible connector.

8. A method according to claim 7 comprising, before the step of joining, milling the outer die so that the predetermined sections of the sheet edges extend therebeyond.

9. A method according to claim 8 wherein, the sheets are joined by electron beam welding.

* * * * *